United States Patent [19]

Raasch et al.

[11] 4,397,144

[45] Aug. 9, 1983

[54] OPEN-END SPINNING DEVICE

[75] Inventors: Hans Raasch, Monchen-Gladbach; Jakob Lenzen, Korschenbroich; Klaus Pohl, Monchen-Gladbach, all of Fed. Rep. of Germany

[73] Assignee: W. Schlafhorst & Co., Monchen-Gladbach, Fed. Rep. of Germany

[21] Appl. No.: 258,371

[22] Filed: Apr. 28, 1981

[30] Foreign Application Priority Data

Apr. 30, 1980 [DE] Fed. Rep. of Germany ..... 3016675

[51] Int. Cl.[3] ..... D01H 1/135

[52] U.S. Cl. ..... 57/414; 57/416

[58] Field of Search ..... 57/404, 413, 414, 416, 57/417

[56] References Cited

U.S. PATENT DOCUMENTS

| | | | |
|---|---|---|---|
| 3,439,487 | 4/1969 | Landwehrkamp | 57/414 |
| 3,789,597 | 2/1974 | Schon | 57/417 |
| 4,167,846 | 9/1979 | Shaw | 57/414 |
| 4,193,253 | 3/1980 | Herbert et al. | 57/414 |

*Primary Examiner*—Donald Watkins

*Attorney, Agent, or Firm*—Herbert L. Lerner; Laurence A. Greenberg

[57] ABSTRACT

Open-end spinning device, including a rotor housing, a spinning rotor being disposed in the rotor housing and having an inner surface, a housing cover having a fiber feeding channel formed therein, a thread delivery orifice being at least partly disposed in the cover and having a hard and wear-resistant material surface at thread deflection locations, and a surface layer of wear-resistant material disposed on the inner surface of the spinning rotor, the surface layer having areas of different wearability distributed therein.

12 Claims, 2 Drawing Figures

OPEN-END SPINNING DEVICE

Figure 1:
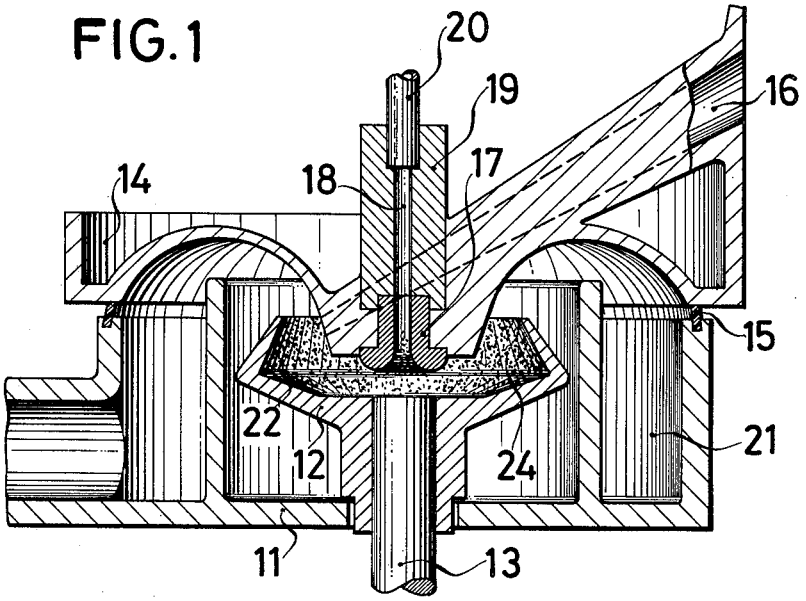

The invention relates to an open end spinning device including a rotor housing, a spinning rotor disposed in the rotor housing, and a housing cover which contains a fiber feeding channel and a thread delivery orifice, the thread delivery orifice being provided with a hard and wear-resistant surface at the places where it deflects the thread.

In rotor spinning devices of this type, excessive wear occurs at locations on the spinning rotors where they are in contact with the fibers and where they are in contact with the thread which is being generated there. The form and surface structure of the spinning rotor have great influence on the structure of the spun thread, and also on the stability of the spinning operation. In the known open-end spinning devices, considerable changes were encountered during the spinning operation in the surface structure and surface properties on the inside of the spinning rotor, at the places which are in contact with the fibers and the thread. This leads to detrimental consequences with respect to the quality of the thread and the stability of the spinning operation.

It is accordingly an object of the invention to provide an open-end spinning device which overcomes the hereinafore-mentioned disadvantages of the heretofore-known devices of this general type, and to make it possible to produce a thread of uniform quality even with an increased operation time and to maintain the stability of the spinning process. Therefore the invention starts from the recognition that no changes in the surface structure and surface properties of the spinning rotor should occur with increasing duration of the spinning operation.

With the foregoing and other objects in view there is provided, in accordance with the invention, an open-end spinning device comprising a rotor housing, a spinning rotor being disposed in the rotor housing and having an inner surface, a housing cover having a fiber feeding channel formed therein, a thread delivery orifice being at least partly disposed in the cover and having a hard and wear-resistant material surface at thread deflection locations, and a surface layer of wear-resistant material disposed on the inner surface of the spinning rotor, the surface layer having areas of different wearability distributed therein.

In accordance with another feature of the invention, the surface layer of wear-resistant material having areas of different wearability distributed therein is also disposed on the thread delivery orifice.

In accordance with a further feature of the invention, the areas of different wearability are insular granular islands having distinct boundaries.

In accordance with an added feature of the invention, the surface layer has pores formed therein forming the areas of different wearability.

Since the surface coating has pores or insular material spots which are limited by the grain boundaries, new pores are opened during the slow wear of the wear-resistant material. This occurs to the same degree in which open pores are disappearing because of wear, so that as a whole the number of open pores, and therefore the surface structure, remains approximately the same until finally at the end of its service life the whole surface layer is worn off. However, because it is possible to choose the thickness of the surface layer, it is possible to advantageously control the functional life of the spinning rotor during which time it functions uniformly. The life span of the whole open-end spinning device is thereby controlled.

Whatever has been said about the wear with respect to the spinning rotor, also applies with respect to the thread delivery orifice.

In rotor-spinning devices of this type, the thread in the thread delivery orifice is deflected into a different direction.

This deflection is approximately at a right angle. The thread therefore slides at high speed through the thread delivery orifice. The thread-forces acting on the thread delivery orifice are dependent on the number of rotations of the rotor, the rotor diameter and the nature of the thread. The force of the thread and the high velocity of the thread cause excessive wear at the places where the thread is deflected into a different direction. Since the form and the surface structure of the thread delivery orifice has a great influence on the structure of the spun thread and on the stability of the spinning operation, the optimal form and surface property of the thread delivery orifice, which is established by experimentation, should not be changed by excessive wear.

In the known open-end spinning devices considerable changes in the surface structure and surface property of the thread delivery orifice were encountered because of wear at places where the thread touches the surface. For example, the wear resulted in a previously smooth surface becoming uncontrollably roughened, or in artificially provided uneven spots being flattened by wear.

In accordance with an additional feature of the invention, there are provided insular inclusions of attrition or easily wearing material in the pores.

In accordance with again another feature of the invention, the areas include material from the group consisting of carbon and iron.

In accordance with again a further feature of the invention, the attrition material includes material from the group consisting of carbon and iron in atomic or molecular form.

In accordance with again an added feature of the invention, the wear-resistant material part of the surface coating or layer is formed of at least one material from the group consisting of carbides, borides and silicides.

In accordance with a concomitant feature of the invention, the carbides, borides and silicides include material from the group consisting of iron, chromeum, nickel, titanium, molybdenum and tungsten.

The insular inclusions in the pores form soft spots which wear faster than the actual surface layer. Insular spots of material which are bounded by the grain boundaries break off during the wear process, and form pores. To prepare for the spinning operation, the surface of the thread delivery orifice is first smoothened and polished. This is done so that in the case of filled pores, the wear material is removed faster than the wear resistant parts of the coating, and in the case of insular spots bounded by the grain boundaries, these islands break off and leave behind open pores. The surface structure thus created remains intact during the spinning operation. The wear process caused by the running thread corresponds to the polishing operation in the beginning.

The surface layer according to the invention can be advantageously created entirely of, or by a combination of, carbides, borides or silicides (boron and silicon compounds), especially of iron, chromium, nickel, titanium, molybdenum or tungsten, as mentioned above. Layers of boron-carbide or silicon carbide can be used advantageously. After the following smoothening and polishing, it is possible to obtain an optimal surface structure for the spinning operation which remains approximately the same on the average, during the whole service life of the spinning rotor, and in some case even during the whole life span of the thread delivery orifice.

Other features which are considered as characteristic for the invention are set forth in the appended claims.

Although the invention is illustrated and described herein as embodied in an open-end spinning device, it is nevertheless not intended to be limited to the details shown, since various modifications and structural changes may be made therein without departing from the spirit of the invention and within the scope and range of equivalents of the claims.

Figure 2:
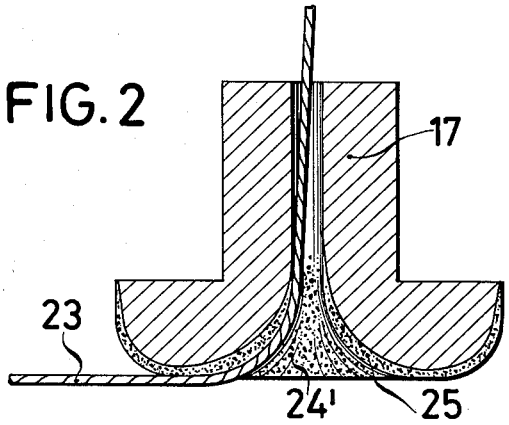

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view, partly broken away, of an open-end spinning device; and FIG. 2 is a cross-sectional view taken through the thread delivery orifice of the spinning device.

Referring now to the figures of the drawing and first particularly to FIG. 1 thereof, there is shown a rotor housing 11, a spinning rotor 12 disposed in the rotor housing, and a rotor shaft 13 extending from the rotor housing 11. The rotor housing 11 is closed by a housing cover 14, including a seal 15. The housing cover 14 is removable. The cover is provided with a fiber-feeding channel 16, a thread delivery orifice 17, and a thread delivery channel 18. The thread delivery channel 18 lies in the interior of an intermediate part 19, in which a thread delivery tube 20 terminates.

During operation, the spinning rotor 12 rotates by means of the shaft 13. Due to negative pressure in a ring channel 21, surrounding the rotor housing 11, air flows in through the fiber feeding channel 16 which, in the conventional manner, transports the spinning fibers into the rotor groove 22 of the spinning rotor 12. From the rotor groove 22, the twisted thread 23 (shown in FIG. 2) is pulled through the thread delivery orifice 17, the thread delivery channel 18, and the thread delivery tube 20. The direction of the thread path changes in the thread delivery orifice over an angle of approximately 90 degrees. It can be seen, especially from FIG. 1, that the spinning rotor 12 which is basically made of steel, is provided, at the places where it comes in contact with the fibers or the thread 23, with a surface layer or coating made of a wear resistant material and that pores 24 are dispersed on the layer. These pores 24 contain attrition material, i.e. material that wears more readily, which is distributed like islands in this layer. It is practical to choose the size of these insular-like arranged particles to be smaller than shown in FIG. 1, down to a microscopic smallness.

It can especially be seen from FIG. 2 that the thread delivery orifice 17, which is basically made of steel, is provided at the places where it deflects the threads to a different direction with a surface layer 25 made of a wear resistant material, including pores 24'. The pores 24' also contain attrition material of the above-mentioned type.

The aim is to achieve a very uniform distribution, and well distributed size, of the insularly arranged particles or material islands of the wear-proof material, which are limited by the grain size. For example, this is assured by the previously-mentioned borides, silicides or carbides.

The invention is not limited to the herein-described and illustrated embodiment. Other different embodiments are possible within the scope of the disclosed invention as well.

The thickness of the surface layer can in practice be for example 200 to 300 micro-meters. However, the thickness can also be smaller or greater. Depending on the method of manufacture, it also does no harm to coat the entire spinning rotor or thread delivery orifice, up to a quasi homogeneous material transformation. The term "coating" should be understood to include not only a layer on an existing substrate, but material transformation which goes from the surface downward. Finally, also included in the scope of protection should be the borderline case in which the whole spinning rotor and the whole thread delivery orifice is formed of the water-resistant material, which is provided with pores or with islands of material that are defined by the grain boundaries.

There is claimed:

1. Open-end spinning device, comprising a rotor housing, a spinning rotor being disposed in said rotor housing and having a pot-shaped inner surface, a housing cover having a fiber feeding channel formed therein, a thread delivery orifice being at least partly disposed in said cover and having a hard and wear-resistant material surface at thread deflection locations, and a surface layer of wear-resistant material completely covering said pot-shaped inner surface of said spinning rotor and being disposed on said thread delivery orifice, said surface layer having areas of different wearability distributed therein.

2. Open-end spinning device according to claim 1, wherein said areas of different wearability are insular granular islands having distinct boundaries.

3. Open-end spinning device according to claim 1, wherein said surface layer has pores formed therein forming said areas of different wearability.

4. Open-end spinning device, comprising a rotor housing, a spinning rotor being disposed in said rotor housing and having an inner surface, a housing cover having a fiber feeding channel formed therein, a thread delivery orifice being at least partly disposed in said cover and having a hard and wear-resistant material surface at thread deflection locations, and a surface layer of wear-resistant material disposed on said inner surface of said spinning rotor, said surface layer having areas of different wearability distributed therein, said surface layer having pores formed therein forming said areas of different wearability.

5. Open-end spinning device according to claim 3 or 4 including insular inclusions of attrition material in said pores.

6. Open-end spinning device according to claim 1, wherein said areas include material from the group consisting of carbon and iron.

7. Open-end spinning device, comprising a rotor housing, a spinning rotor being disposed in said rotor housing and having an inner surface, a housing cover having a fiber feeding channel formed therein, a thread delivery orifice being at least partly disposed in said cover and having a hard and water-resistant material surface at thread deflection locations, and a surface layer of wear-resistant material disposed on said inner surface of said spinning rotor, said surface layer having areas of different wearability distributed therein, said areas of different wearability being insular granular islands having distinct boundaries.

8. Open-end spinning device according to claim 2 or 7, wherein said areas include material from the group consisting of carbon and iron.

9. Open-end spinning device according to claim 3 or 4, wherein said areas includes material from the group consisting of carbon and iron.

10. Open-end spinning device according to claim 5, wherein said attrition material includes material from the group consisting of carbon and iron.

11. Open-end spinning device according to claim 1, wherein said wear-resistant material is formed of at least one material from the group consisting of carbides, borides and silicides.

12. Open-end spinning device according to claim 11, wherein said carbides, borides and silicides include material from the group consisting of iron, chromium, nickel, titanium, molybdenum and tungsten.

* * * * *